US008759805B2

(12) United States Patent
Lambert et al.

(10) Patent No.: US 8,759,805 B2
(45) Date of Patent: Jun. 24, 2014

(54) RADIATION SHIELDING BARRIERS

(71) Applicants: Fred Lambert, Sherwood Park (CA); David Lambert, Ardrossan (CA)

(72) Inventors: Fred Lambert, Sherwood Park (CA); David Lambert, Ardrossan (CA)

( * ) Notice: Subject to any disclaimer, the term of this patent is extended or adjusted under 35 U.S.C. 154(b) by 0 days.

(21) Appl. No.: 13/735,812

(22) Filed: Jan. 7, 2013

(65) Prior Publication Data

US 2013/0175461 A1 Jul. 11, 2013

Related U.S. Application Data

(60) Provisional application No. 61/583,852, filed on Jan. 6, 2012.

(51) Int. Cl.
*G21F 3/04* (2006.01)

(52) U.S. Cl.
USPC ..... 250/517.1; 250/515.1; 52/407.4; 52/408; 52/481.1; 52/483.1

(58) Field of Classification Search
USPC ..... 250/517.1, 515.1; 52/407.4, 408, 481.1, 52/483.1
See application file for complete search history.

(56) References Cited

U.S. PATENT DOCUMENTS

| | | | | |
|---|---|---|---|---|
| 1,780,107 A | | 3/1929 | Barry | |
| 1,780,108 A | | 3/1929 | Barry | |
| 4,038,553 A | | 7/1977 | McCullagh | |
| 4,454,905 A | * | 6/1984 | Banko, Jr. | 160/351 |
| 4,515,640 A | | 5/1985 | Kaschig et al. | |
| 5,883,394 A | * | 3/1999 | Mussman | 250/515.1 |
| 6,550,203 B1 | * | 4/2003 | Little | 52/407.4 |
| 2010/0212243 A1 | | 8/2010 | Lesoine | |

FOREIGN PATENT DOCUMENTS

| | | |
|---|---|---|
| EP | 1477991 | 11/2004 |

OTHER PUBLICATIONS

International search report and written opinion in applicant's corresponding international application No. PCT/CA2013/05008 published as WO2013/102277 on Jul. 11, 2013.

* cited by examiner

*Primary Examiner* — Jack Berman
*Assistant Examiner* — Meenakshi Sahu
(74) *Attorney, Agent, or Firm* — Anthony R. Lambert

(57) ABSTRACT

Articles of manufacture and a method of how to utilize the same in order to create a radiation shielding barrier wall assembly. A metal stud and a metal support bar and a metal restraining bar and a prefabricated radiation shielding lead panel whereby the assembly of these components in the manner as directed and in conjunction with commercially available preexisting metal stud components will result in all radiation shielding lead panels overlapping at all interior field joints, and will result in no punctures or damage in any way to the radiation shielding lead created by the attachment method, creating a radiation shielding leak-proof metal stud system.

28 Claims, 12 Drawing Sheets

RADIATION SHIELDING BARRIERS

CROSS-REFERENCE TO RELATED APPLICATIONS

This application claims the benefit under 35 USC 119(e) of U.S. provisional application Ser. No. 61/583,852 filed Jan. 6, 2012.

TECHNICAL FIELD

Radiation Shielding Barriers, also known as Radiation Protection Barriers

BACKGROUND

Generally, a room designed to shield against ionizing radiation e.g.: X-Rays/Gamma Rays will require a continuous lead barrier, in the walls to a height of 2100 mm or higher that is designed to attenuate the ionizing radiation being emitted from the imaging equipment installed in the room.

Generally the current method used in the attempt to provide a lead radiation shielding barrier is to construct a metal stud partition, installing to one side of the gyproc, a layer of sheet lead laminated to the back face. The laminated gyproc's manufacturers' installation instructions direct the installer to screw the laminated gyproc to the studs through predrilled fastening holes, then countersink all of the fastening screw heads, minimum 3 mm, through the face paper allowing for attachment of lead screw caps over, screwing the laminated gyproc to the studs through pre-drilled fastening holes. This act of countersinking the screws into the gypsum may destroy the structural integrity of the gypsum board.

Additionally, once the screws are countersunk in the gypsum board, lead screw caps or buttons are hammered into position over every screw. This may be costly in both construction time and labour cost. Many caps/buttons are not properly installed or not installed at all allowing radiation leaks. Moreover in the angular incidence there is not enough steel in the drywall screws to provide attenuation equivalent to that provided by the lead.

Furthermore, in addition to lead screw caps, a strip of sheet lead equaling the attenuating capability of the lead laminated gypsum board must be installed between the leaded face of the gypsum board and the face of the metal stud where two or more sheets of gypsum board are butted together, to prevent leakage at this seam. This may be costly in both construction time and labour cost. Many joining strips are left out allowing large gaps for ionizing radiation leaks.

Other leak-proof barrier systems were allegedly created without the lead screw caps being installed over every screw or the strip of sheet lead designed to provide radiation shielding not being installed at the seams. U.S. Pat. No. 6,550,203 to Little suggests that when a lead barrier plate is installed which extends beyond the flanges of the metal stud, the countersunk holes and the lead strip added at the juncture where two or more sheets of lead laminated gypsum board abut, are no longer required.

U.S. Pat. No. 4,038,553 to McCullagh discloses a clamping apparatus having a stud capturing portion and a stud facing portion bolted together to clamp a lead sheet.

All previously described methods of creating a radiation leak proof lead barrier systems require extensive time consuming skilled labour to install.

In addition, the integrity of the lead in some previously described systems is compromised by requiring fixed sizes of components that are not adjustable to accommodate different thicknesses or weights of lead.

In addition, the lead attachment method described in some previously described systems is compromised by way of the system itself being difficult to access, difficult to install or too unclear for installers during installation procedures.

In addition, the lead attachment method described in some previously described systems is compromised by way of the system itself failing to meet the guidelines for the structural support of lead sheets set out by the International Lead Association (London).

In addition, the installation of any electrical devices, such as for example, switches or receptacles; or plumbing fixtures, such as water supply and drainage lines, that are required to be installed in walls, would require either damaging or penetrating the lead barrier or would not allow the barrier to be installed at all.

SUMMARY

There is provided in an embodiment a radiation shielding barrier wall assembly comprising wall elements including studs and support bars attached to and extending between the studs, sheets of radiation shielding material suspended from the support bars; and adjacent sheets of radiation shielding material overlapping on either side of a portion of a stud. In various embodiments, there may be included any one or more of the following features: the radiation shielding barrier wall assembly may have at least a stud which is elongated in a first direction, and a cross section in the plane perpendicular to the first direction having bends and legs between the bends, the cross section of the stud comprising a first leg at one end of the cross section and a second leg at another end of the cross section and further comprising an offset leg located between the first leg and the second leg, the offset leg being arranged to allow a sheet of radiation shielding material supported by a wall element to one side of the stud to extend adjacent to the offset leg to overlap with a sheet of radiation shielding material supported adjacent to the offset leg by a wall element to the other side of the stud. The radiation shielding barrier wall assembly may also have a restraining bar attached to the at least a stud to hold the sheet of radiation shielding material extending adjacent to the leg. The radiation shielding barrier wall assembly may also have finishing material attached to the studs and enclosing the sheets of radiation shielding material. The studs may extend between a top track and a bottom track. The radiation shielding barrier wall assembly may also have a corner assembly for a bend in the wall, the corner assembly comprising radiation shielding material attached such as by lamination to sheet metal, the corner assembly being attached to a stud at one side of the corner assembly, and attached to another stud at an opposite side of the corner assembly, and the corner assembly having a bend between the side and the opposite side.

There is provided in an embodiment a radiation shielding barrier wall assembly comprising studs, support bars attached to and extending between the studs, and sheets of radiation shielding material suspended from the support bars. In another embodiment, there is provided a radiation shielding barrier wall assembly comprising wall elements including studs, sheets of radiation shielding material supported by the wall elements and adjacent sheets of radiation shielding material overlapping on either side of a portion of a stud.

In various embodiments, there may be included any one or more of the following features: the radiation shielding barrier wall assembly may have at least a stud which is elongated in a first direction, and has a cross section in the plane perpendicular to the first direction having bends and legs between the bends, the cross section of the stud comprising a first leg at one end of the cross section and a second leg at another end of the cross section and further comprising an offset leg located between the first leg and the second leg, the offset leg being arranged to allow a sheet of radiation shielding material suspended from a support bar to one side of the stud to extend adjacent to the leg to overlap with a sheet of radiation shielding material suspended from a support bar to the other side of the stud. The radiation shielding barrier wall assembly may also have a restraining bar attached to the at least a stud to hold the sheet of radiation shielding material extending adjacent to the leg. The radiation shielding barrier wall assembly may also have finishing material attached to the studs and enclosing the support bars and sheets of radiation shielding material. The studs may extend between a top track and a bottom track. The sheets of radiation shielding material may each have a foldover edge which extends over the top of a support bar when the respective sheet of radiation shielding material is suspended from the respective support bar. The radiation shielding barrier wall assembly may also have a corner assembly for a bend in the wall, the corner assembly comprising radiation shielding material attached such as by being laminated to sheet metal, the corner assembly being attached to a stud at one side of the corner assembly, and attached to another stud at an opposite side of the corner assembly, and the corner assembly having a bend between the side and the opposite side. The sheets of radiation shielding material may comprise lead panels.

In an embodiment there is provided a kit for producing a radiation shielding barrier wall assembly, the kit comprising wall elements including studs and support bars attached to and extending between the studs, the support bars configured to suspend sheets of radiation shielding material, and the studs configured to accept sheets of radiation shielding material overlapping on either side of portions of a stud.

In an embodiment there is provided a stud for use in a radiation shielding barrier wall assembly, the stud being elongated in a first direction, and having a cross section in the plane perpendicular to the first direction having bends and legs between the bends, the cross section of the stud comprising a leg generally in the middle of the cross section of the stud, the leg arranged to allow a sheet of radiation shielding material supported to one side of the stud to extend adjacent to the offset leg to overlap with a sheet of radiation shielding material supported adjacent to the offset leg to the other side of the stud. In a further embodiment the stud may also have at least a hole to attach a support bar to the stud for suspending a sheet of radiation shielding material.

Lead sheets may be color coded according to the thickness of the lead sheets.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
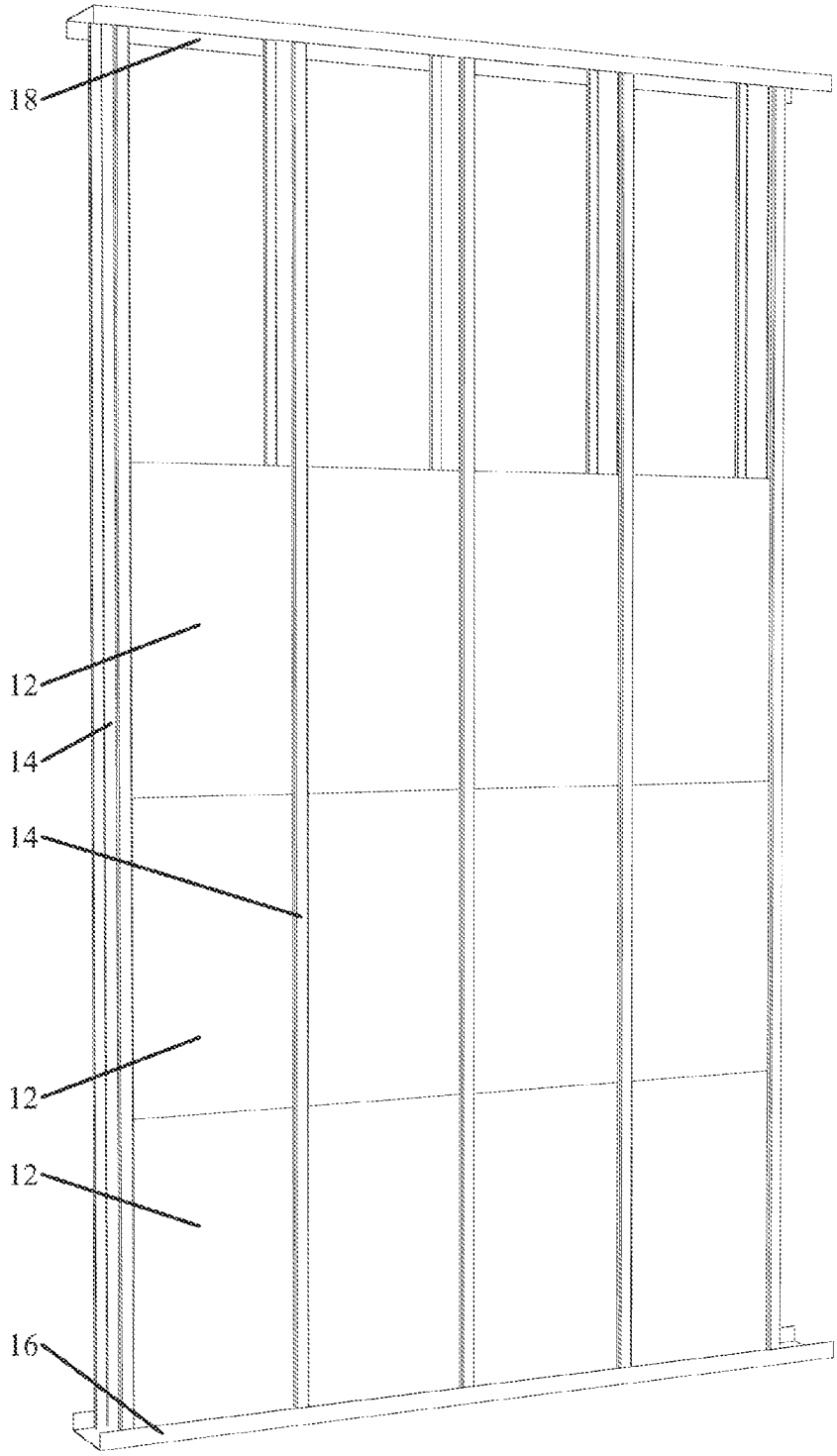
FIG. 1 shows a perspective view of an assembly comprising a top track, bottom track, five studs, and twelve radiation shielding lead panels. Additionally, twelve metal support bars and four metal restraining bars would be present in this assembly but are not visible in this illustration.

The following objects apply to one or more embodiments, but may not apply to all embodiments. It is an object in at least an embodiment of the invention to provide a radiation shielding barrier without the need for lead lined drywall, lead buttons, and lead strips.

Another object in at least an embodiment is to permit elimination of the need for an installer specializing in lead installations only and allow the system to be installed by other skilled trades.

Another object in at least an embodiment is to reduce the construction time of shielded rooms.

Another object in at least an embodiment is to allow for easy installation of mechanical and electrical components in shielded rooms, without the need for additional back-up shielding behind devices and components.

Another object in at least an embodiment is to allow for easy renovation, removal, reinstallation and recycling of the components of the system.

Another object in at least an embodiment is to make the system fit (match) pre-existing standard components (re: 6" metal standard track).

Another object in at least an embodiment is to make repairs to drywall on the wall system easier by preventing damage to the radiation shielding lead sheet material by placing it in or near the centre of the wall cavity.

Another object in at least an embodiment is to protect the health of construction workers renovating or removing such walls by suspending lead at the centre of the wall cavity and by making the lead easy to remove, store or reuse. Also, each lead panel may be painted both sides to protect those who handle these panels and marked as to its Pb content.

Therefore, there is provided in one or more embodiments a radiation shielding leak-proof barrier system having a new metal stud configuration that permits elimination of the need for use of lead laminated gypsum board, elimination of the need for use of lead screw caps, and elimination of the need for use of lead barrier tabs/overlap plates. Some embodiments permit elimination of the need for the installers to simultaneously handle both the drywall and lead sheets and thus reduces the chance of injury to the installer by reducing material weight during construction and thereby reduces both the quantity and severity of injury claims by installers. In one or more embodiments, the system assists in preventing damage to the lead and thus compromise to the integrity of the shielding in the event of an impact with the drywall either during construction or during normal use of the completed building. In one or more embodiments, the system assists in preventing future sag and deformity of lead sheets by method of continuous support bars acting as continuous support for the lead sheet. In one or more embodiments, the system assists in ensuring the wall will not fail due to incorrectly sized metal studs being used as only the specific studs as designed will accept the support bar. In one or more embodiments, the system assists in reducing construction time by way of the components being prefabricated into simple and readily assembled components. In one or more embodiments, the system assists in providing maximum protection against radiation leakage by way of sheets of radiation shielding material being properly overlapped, supported continuously along their length, and installed to the required height and in the required positioning due to the design of each component and the method of assembly of the complete radiation shielding barrier system.

Radiation shielding material may comprise lead or any other suitable radiation shielding material. The type of material depends on the radiation intended to be attenuated by the material. Thus, for gamma/X-rays emitted for example by an X-ray source in a room defined by the disclosed walls, a suitable material would be a dense metal such as lead.

Wall elements may include studs and support bars, not necessarily exactly as disclosed herein, but suitable for supporting sheets of radiation shielding material. A metal stud in an embodiment is configured to accept metal support bars and metal restraining bars, configured to accept radiation shielding lead panels, and assembled so that when assembled according to provided instructions, radiation shielding lead sheets will overlap and thereby create a radiation leak proof metal stud system. Leak proof in this context means that there is no free path for radiation to pass through the wall without encountering radiation shielding material.

In an embodiment in which the radiation shielding lead panels are suspended and fastened from metal support bars, no penetrations need be made in the portion of the lead that faces the room, enabling the creation of a radiation leak proof metal stud system.

Furthermore, radiation shielding lead panels may be sized appropriately according to the structural strength of the metal support bars and held and secured to the metal support bars, the radiation shielding lead panels may be evenly supported and no portion of the radiation shielding lead panel need be stressed from a single fastener, and thus the radiation shielding lead panels may remain in place without deforming for the lifespan of the building.

Furthermore, the use of radiation shielding lead panels do not need any drywall screws to penetrate the lead and this eliminates the need for lead screw caps, and thereby enabling the creation of a radiation shielding leak proof metal stud system. Mechanical, electrical or any other services would be installed on the side of the radiation shielding barrier, it is to serve, to avoid penetrating the radiation shielding barrier.

Furthermore, in at least an embodiment, electrical devices, such as for example, switches or receptacles; or plumbing fixtures, such as water supply and drainage lines, are able to be installed as they would be in a traditional metal stud wall, without damage to the radiation shielding barrier and without the use of additional shielding, thereby simplifying the construction process and maintaining a radiation leak proof metal stud system. Should additional room be needed for the placement of electrical or mechanical items either side of the radiation shielding barrier, the installation of a furring wall could be placed of a thickness required.

Furthermore, during renovations or removal of existing lead lined gypsum board systems, precautions must be taken to prevent contamination of the work area and danger to the health of personnel due to the fact that lead is a toxic material. If renovations are required to walls consisting of this metal stud system, such renovations may be more easily accomplished as the gypsum board need not itself contain lead, the radiation shielding lead material panels are painted to encapsulate the lead and may be easily removable and in at least an embodiment may be stored, reused, or easily recycled.

Furthermore, if repairs to the drywall surface are required, in at least an embodiment such repairs can be completed without the need to repair the radiation shielding lead surface.

In an embodiment there is provided a metal stud system of accepting and supporting radiation shielding lead panels for radiation shielding wall construction, wherein the metal stud is configured with an 's' bend in it to ensure proper placement and alignment and lead overlap, and is configured to accept metal support bars which fit into a specific configuration to allow for proper radiation shielding lead support and alignment and overlap, which in turn support preformed radiation shielding lead panels that are configured to fit into the wall system and provide for proper support, fastening and overlap. Although in this embodiment radiation shielding lead panels are used as sheets of radiation shielding material, other embodiments may use any other suitable radiation shielding material.

FIG. 1 shows a perspective view of an assembly comprising a top track 18, bottom track 16, five studs 14, and twelve radiation shielding lead panels 12. Additionally, twelve metal support bars and four metal restraining bars would be present in this assembly but are not visible in this illustration. The radiation shielding lead panels 12 can be a variety of thicknesses to suit the intended application. Typical installations (suitable for most hospital diagnostic imaging rooms) will use 4 lbs/sq ft (1.58 mm thick) lead, 6 lbs/sq ft (2.37 mm thick) lead and 8 lbs/sf (3.16 mm thick) lead. The radiation shielding lead panel may be made of sheet lead, configured to a specific shape and bent 90 degrees at fold line to create a foldover edge (22) (not shown in FIG. 1). The studs 14 may be made of galvanized sheet steel, thickness 20 gauge but can be made in different thicknesses if required. The studs must be made of steel or similar high strength material. The studs are currently available 10' long but can be any length to suit project requirements. The studs may have a dimpled texture pressed into the surface of the two legs that are in contact with drywall. This feature is not present in, but could be added to, the embodiment shown in the figures. This is to provide better grip for drywall screws when they are being installed. The top track 18 and bottom track 16 are pre-manufactured items. The top track can be a single or double top track or in another configuration if required.

Figure 2:
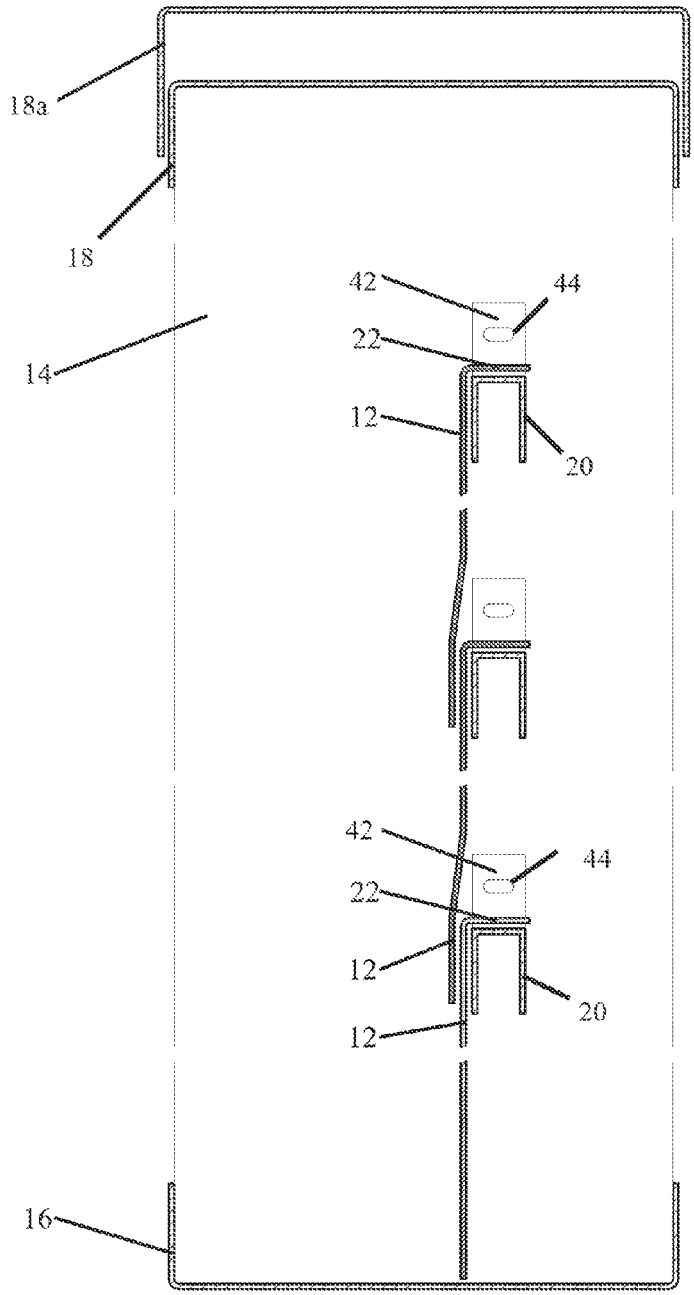
FIG. 2 shows a side section view through the assembly of FIG. 1, showing radiation shielding lead panels, metal support bars, a stud, top tracks, and bottom tracks.

FIG. 2 shows a side section view through the assembly of FIG. 1, showing radiation shielding lead panels 12, metal support bars 20, a stud 14, top tracks 18, and bottom tracks 16. In the embodiment shown inner top track 18 is set into but not fastened to outer top track 18*a*, an arrangement known as deflection track assembly, which allows for normal movement of the structure without causing drywall cracking in the wall below. Lead shielding panels 12 are hung from support bars 20 which are suspended between studs 14 (only one stud is visible in this view). The holding or support bars 20 span between two studs 14 and attach to the studs in predetermined locations (pre-drilled, or with holes formed by punching or in some other fashion) 40 with fasteners 26 (pre-drilled or punched locations and fasteners not shown in FIG. 2). The bars 20 are designed to accept radiation shielding lead panels 12 so that foldover edge 22 of radiation shielding lead panel 12 folds over the top of the support bar and is fastened with mechanical fasteners 24 (not shown in FIG. 2). The bars 20 are U-shaped in cross section with two tabs 42 (one on each end) sticking upwards to allow fastening. The tabs have in this embodiment slots 44 for receiving fasteners to attach the tabs to the studs. The bars may be made of galvanized sheet metal, 20 gauge or to suit project requirements. The foldover edge 22 of radiation shielding lead panel 12 sits on top of metal support bar 20. The installer should secure radiation shielding lead panel 12 through the foldover edge 22 with mechanical fasteners 24. The mechanical fasteners help prevent the lead radiation shielding panel from falling off if the wall is disturbed or if the panel is bumped during other construction work.

Figure 3:
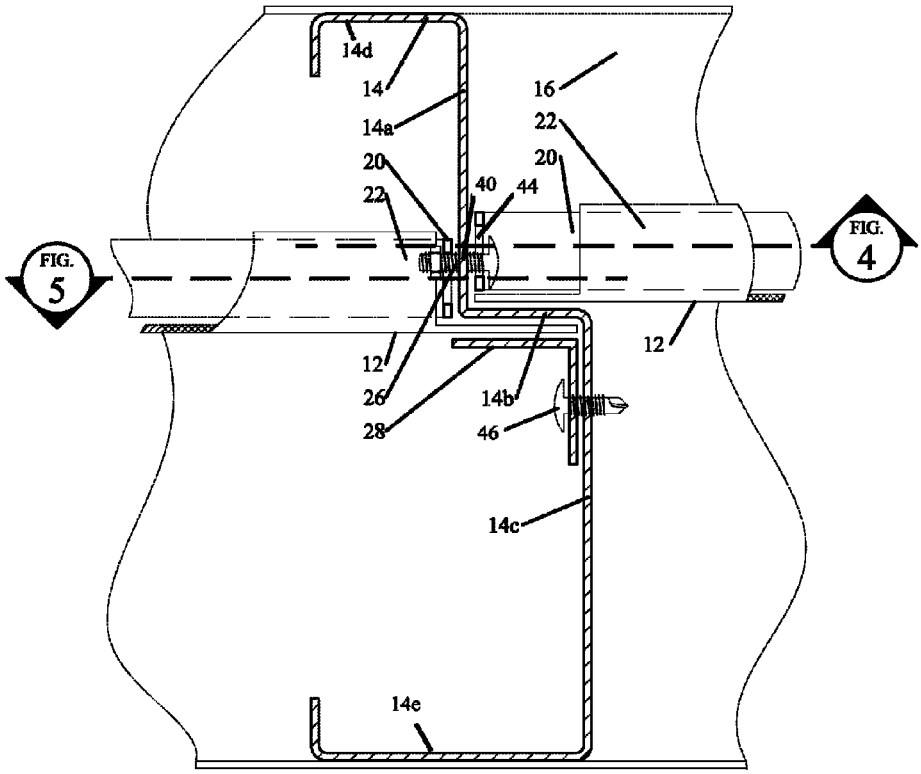
FIG. 3 shows a top section view through a portion of the assembly of FIG. 1, showing a stud, support bars, radiation shielding lead panels, and bottom tracks.

FIG. 3 shows a top section view through a portion of the assembly of FIG. 1, showing a stud 14, support bars 20, radiation shielding lead panels 12, and bottom tracks 16. As can be seen in FIG. 3, the stud 14 has a shape having legs 14*a*, here 2.5 inches long but can be adjusted as required, offset leg 14*b*, 1 inch long to allow overlap as prescribed by code and not recommended to have any other length, and leg 14*c*, here 3.5 inches long but can be adjusted as required. The stud 14 is elongated in the direction perpendicular to the cross-section. The stud also has legs 14*d* and 14*e* at the ends of the cross-section visible in FIG. 3. Attached to stud 14 by mechanical fastener 46 is restraining bar 28. The restraining bar 28 may be an L-shaped clip, or may be another shape as required. This component may not be necessary, i.e. it is only needed if the radiation shielding lead is bent (ie old panel being reinstalled, if the wall is sloped to the extent that the radiation shielding lead hangs away from the surface of the stud (14), drafts or air movement in the wall necessitate additional restraining of the radiation shielding lead, or other reasons why the radiation shielding lead may not sit flat). The restraining bar 28 may be made of metal or similar rigid material; in the embodiment shown it is made of 20 gauge galvanized steel. A further mechanical fastener 26 attaches support bars 20 to stud 14. This fastener is currently shown as a small bolt & nut. It is preferably a bolt & nut or similar fastener as this will use preexisting holes 40 punched or drilled in the metal stud leg 14*a* and slot 44 in the support bar 20. Although a single fastener is shown to attach two support bars to a stud, in alternate embodiments multiple fasteners could be used for each support bar and each fastener may be used to attach only a single support bar to a stud. For example, the support bars could have tabs with multiple prongs that are not aligned with the prongs on the corresponding support bar on the opposite side of a stud, and each prong having a fastener, there being a corresponding hole in the stud for each fastener.

Figure 4:
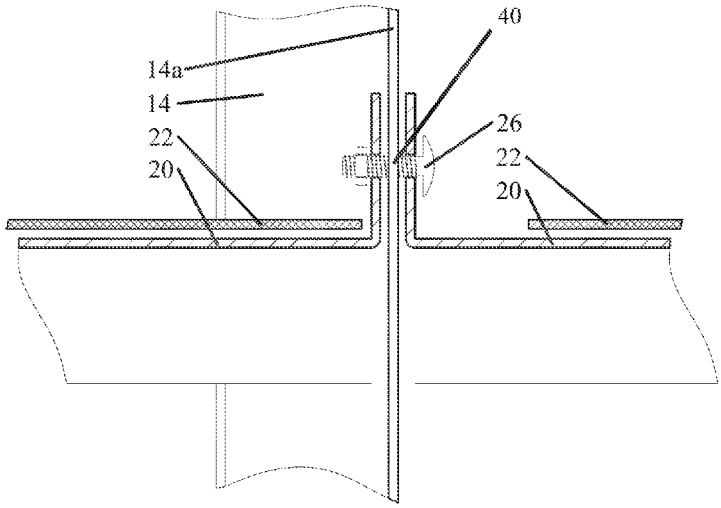
FIG. 4 shows a section view facing forwards through the connection point from the stud to two metal support bars in the assembly of FIG. 3.

FIG. 4 shows a section view facing forwards through the connection point from the stud 14 to two metal support bars 20 in the assembly of FIG. 3. In this figure are shown the stud 14, support bars 20 with tabs connected to leg 14*a* of the stud 14 with fastener 26, and foldover edge 22 of radiation shielding lead sheets 12 lying on top of support bars 20 (main portion of radiation shielding lead sheets 12 not visible in the figure as they lie behind the plane of view).

Figure 5:
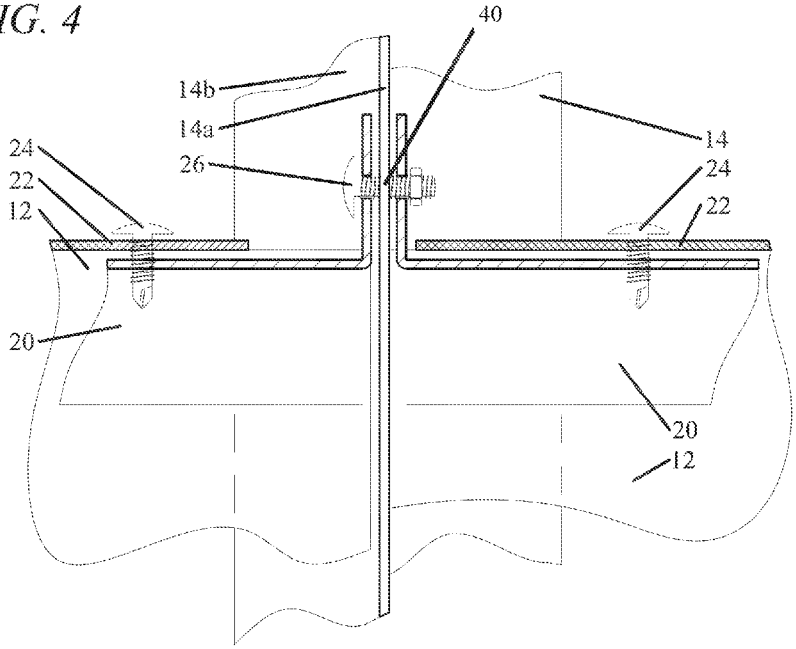
FIG. 5 shows a section view facing rearwards through the connection point from the stud to two metal support bars in the assembly of FIG. 3.

FIG. 5 shows a section view facing rearwards through the connection point from the stud 14 to two metal support bars 20 in the assembly of FIG. 3. In this figure are shown the stud 14, support bars 20 with tabs connected to leg 14*a* of the stud with fastener 26, and foldover edge 22 of radiation shielding lead sheets 12 lying on top of support bars 20. Foldover edges 22 of radiation shielding lead sheets 12 are attached to support bars 20 with mechanical fasteners 24. These are currently shown as self-tapping screws, but could be regular screws, rivets, crimps, pins, clamps, or some other form of mechanical fastening device. In this view the radiation shielding lead sheet 12 on the right hand side of the figure extends behind leg 14*b* of stud 14 to overlap with the radiation shielding lead sheet 12 on the left hand side of the figure.

Figure 6:
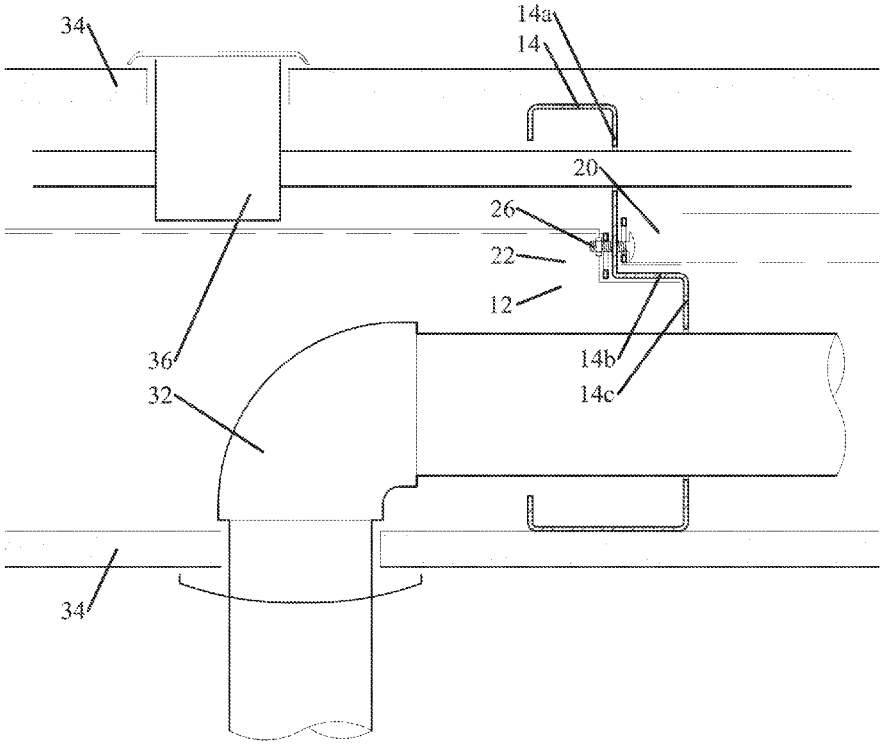
FIG. 6 shows a way to use the metal stud in the present invention to create a radiation shielding leak-proof barrier around electrical and mechanical equipment and receptacles without the need for special or custom construction, while maintaining the integrity of the shielding.

FIG. 6 shows a way to use the metal stud in the present invention to create a radiation shielding leak-proof shielding barrier around electrical and mechanical equipment and receptacles without the need for special or custom construction, while maintaining the integrity of the shielding. Finishing material 34 is attached to the outside edges of stud 14 to cover the sides of the wall. Finishing material 34 may be gypsum board or any other type of wall finishing product or material. A finish material acts to protect the radiation shielding lead from damage. Pipe 32 may also be a chase, conduit, or other mechanical or electrical or other piece of equipment or hardware typically concealed inside a wall. Electrical equipment 36 may also be another electrical or mechanical equipment or device or control. Pipe 32 and electrical equipment 36 are shown to indicate that equipment such as this can be installed in the wall without the need for additional radiation shielding.

Figure 7:
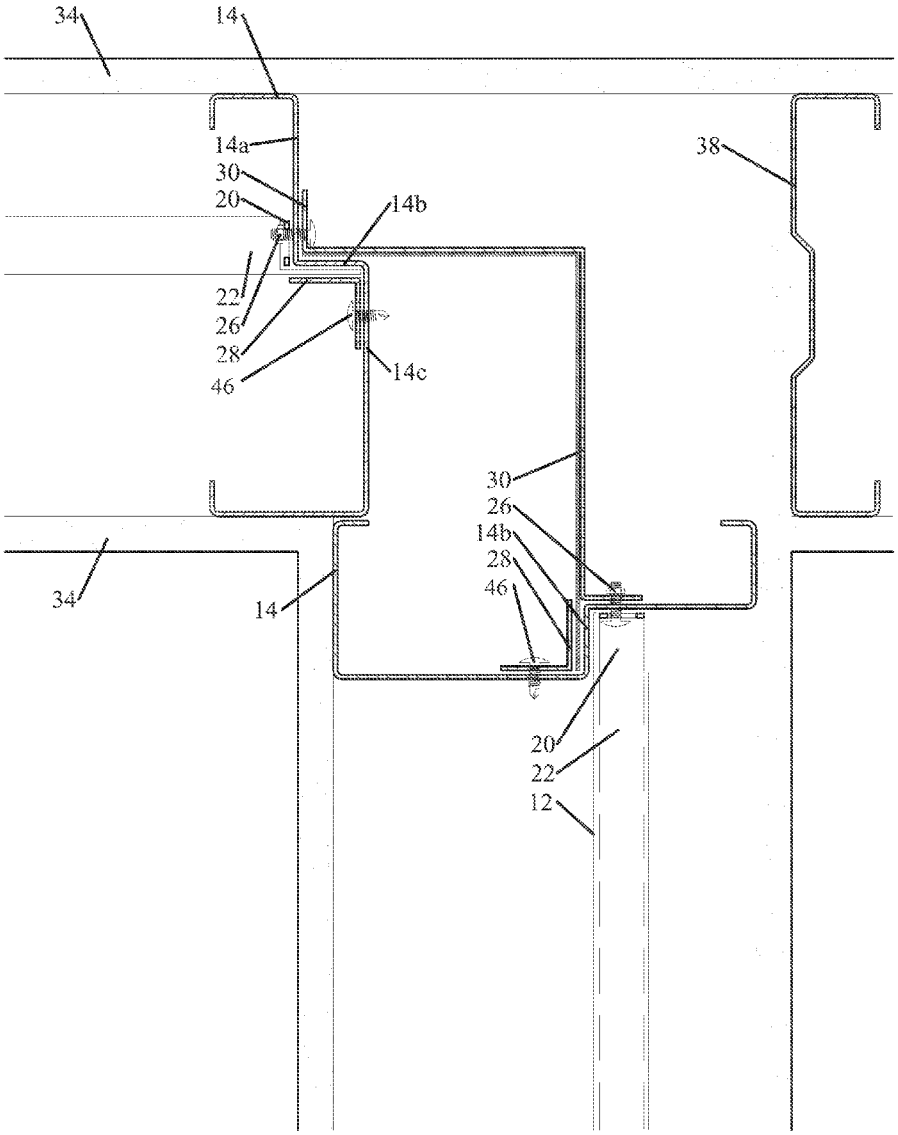
FIG. 7 shows a way to use the metal stud at a corner where a shielded wall meets an unshielded wall, while maintaining the integrity of the shielding.

FIG. 7 shows a way to use the metal stud at a corner where a radiation shielded wall meets an unshielded radiation shielding wall, while maintaining the integrity of the radiation shielding. A metal corner assembly 30 may comprise radiation shielding lead laminated to sheet metal. The corner assembly as shown in FIG. 7 is for a bend in the shielded wall, which could be unconnected to any unshielded walls or at a T-junction or + junction. Variants of the corner assembly could be used at a T-junction or a + junction between any combination of shielded or unshielded wall assemblies. The legs can be of varying length to suit project requirements, and the angle of the centre bend (shown 90 degrees) can be any angle or combination of angles, including 0°, 180°, 360° etc., as required to suit project requirements. The corner assembly 30 may be fastened to stud 14 with mechanical fasteners 26. Also visible in this figure is commercially available metal stud 38, showing how current metal stud 14 is the same overall width and depth as a commercially available metal stud 38 and thus the current metal stud 14 can be used with standard components from commercially available metal stud wall systems, and showing how radiation shielded and unshielded walls can be constructed together easily.

Figure 8:
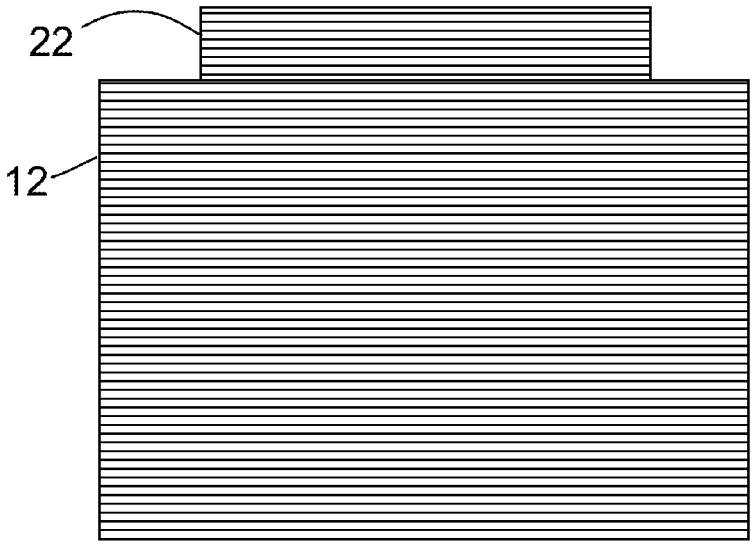
FIG. 8 illustrates a radiation shielding lead panel, not to scale, shown with the fold line indicated by a solidline. Maximum size of lead panels is dictated by the International Lead Association (London). Horizontal hatching indicates a color.
Figure 9:
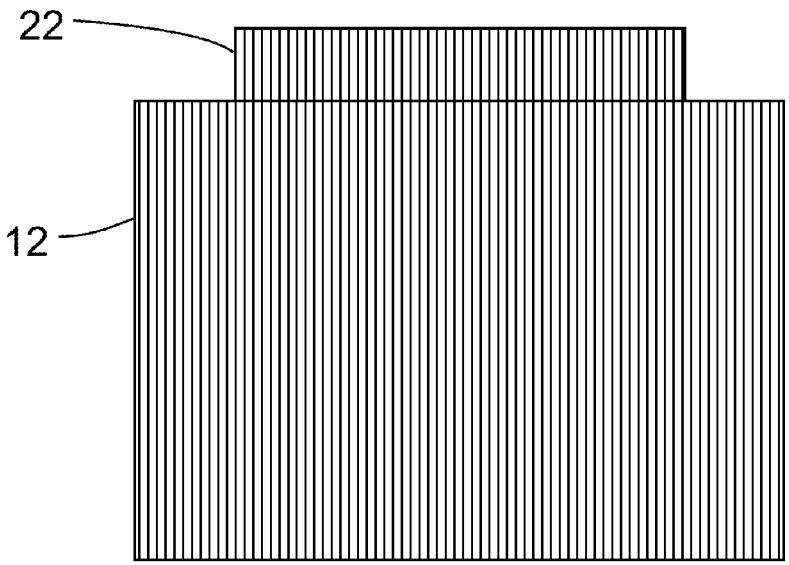
FIG. 9 illustrates another radiation shielding lead panel, with vertical hatching indicating a different color.

FIG. 8 illustrates a radiation shielding lead panel 12, not to scale, shown with the fold line between the main body of radiation shielding lead panel 12 and foldover edge 22 of radiation shielding lead panel 12 indicated by a solid line. Lead panels are sized to meet requirements of the International Lead Association (lead). The lead panel may be color-coded to indicate the thickness of the panel, for example by painting some or all of the surface of the lead panel. Horizontal hatching in FIG. 8 indicates a color. FIG. 9 illustrates a different lead panel with a different color indicated by vertical hatching.

Figure 10:
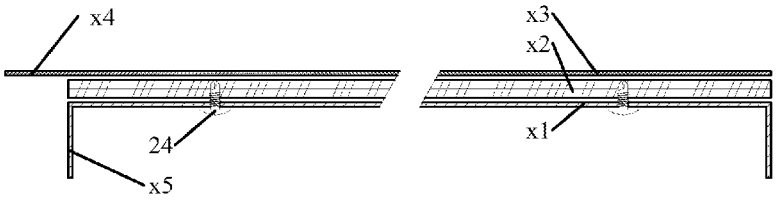
FIG. 10 is a plan detail of a panel at a sheet metal fastening bracket.
Figure 11:
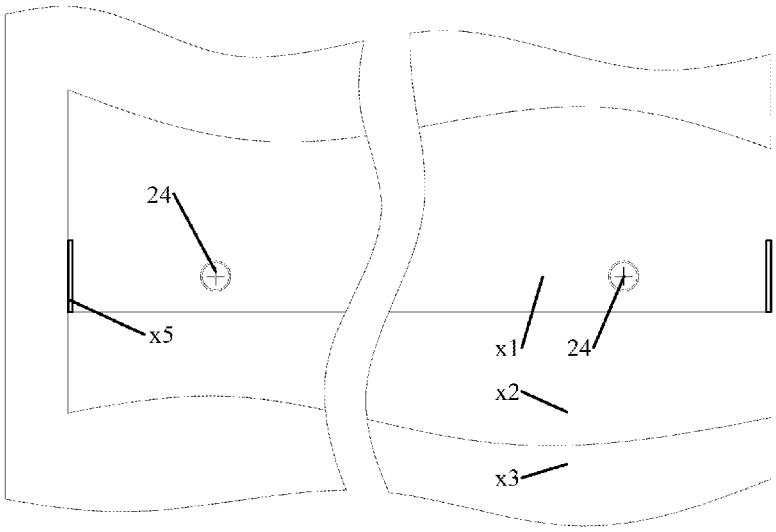
FIG. 11 is an elevation detail of the panel of FIG. 10.
Figure 12:
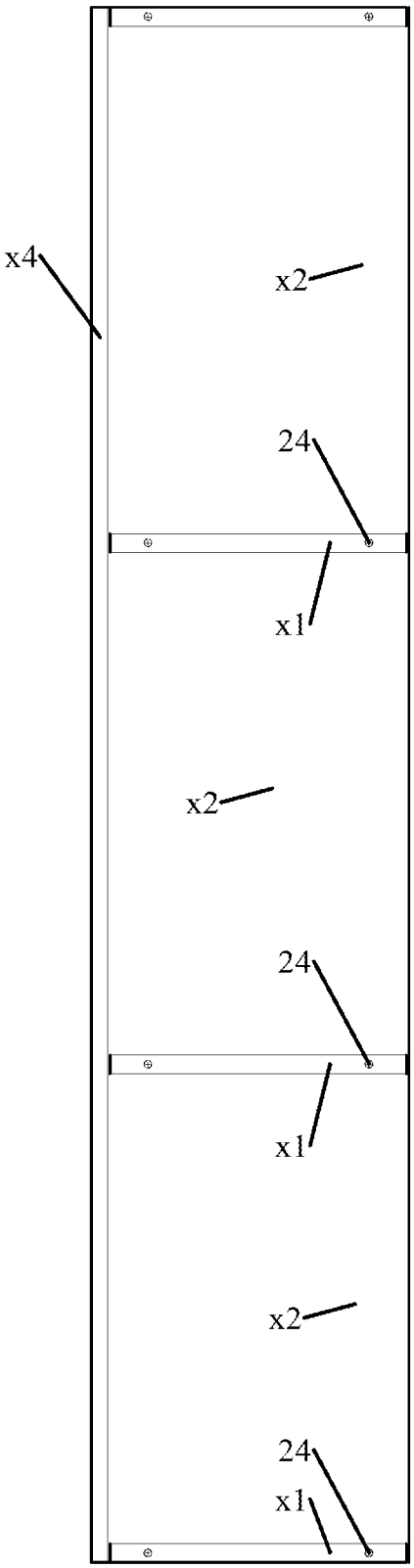
FIG. 12 is an overall elevation of the panel of FIG. 11.
Figure 13:
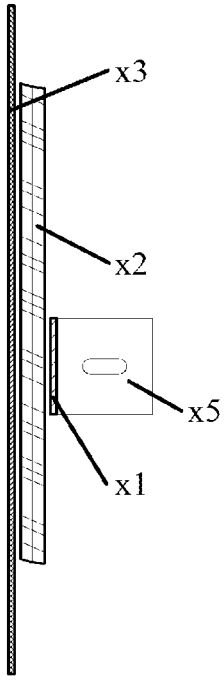
FIG. 13 is a section detail of the panel of FIG. 12 showing an end return of a metal fastening bracket.

FIG. 10 is a plan detail of another embodiment of a radiation shielding panel, shown at a sheet metal fastening bracket x1. The bracket is attached to a substrate x2, such as ¼" plywood, although it could be a different thickness or material. A lead sheet x3 of any required thickness is laminated to the substrate. The lead sheet may extend a length x4, for example ⅞", beyond one end of the bracket. Mechanical fasteners 24, which may be screws or another fastener such as a rivet, attach the fastening bracket to the substrate but preferably do not pierce the lead. FIG. 11 is an elevation detail of the panel of FIG. 10. Wavy lines in FIG. 11 indicate continuing surfaces. As can be seen in FIG. 11, the sheet metal fastening bracket x1 extends across the panel but covers only a portion of its surface area. FIG. 12 is an overall elevation of the panel of FIG. 11, showing several fastening brackets x1 traversing the panel and a strip of lead x4 extending from one edge of the panel. FIG. 13 is a section detail of the panel of FIG. 12 showing an end return x5 of a metal fastening bracket x1. The end return may be 1" square and may have a slotted hole punched in it and in the corresponding return at the other end of the bracket. The panel of FIGS. 10-13 may be color-coded to indicate the thickness of the lead, for example by painting some or all of the surface of the lead.

Figure 14:
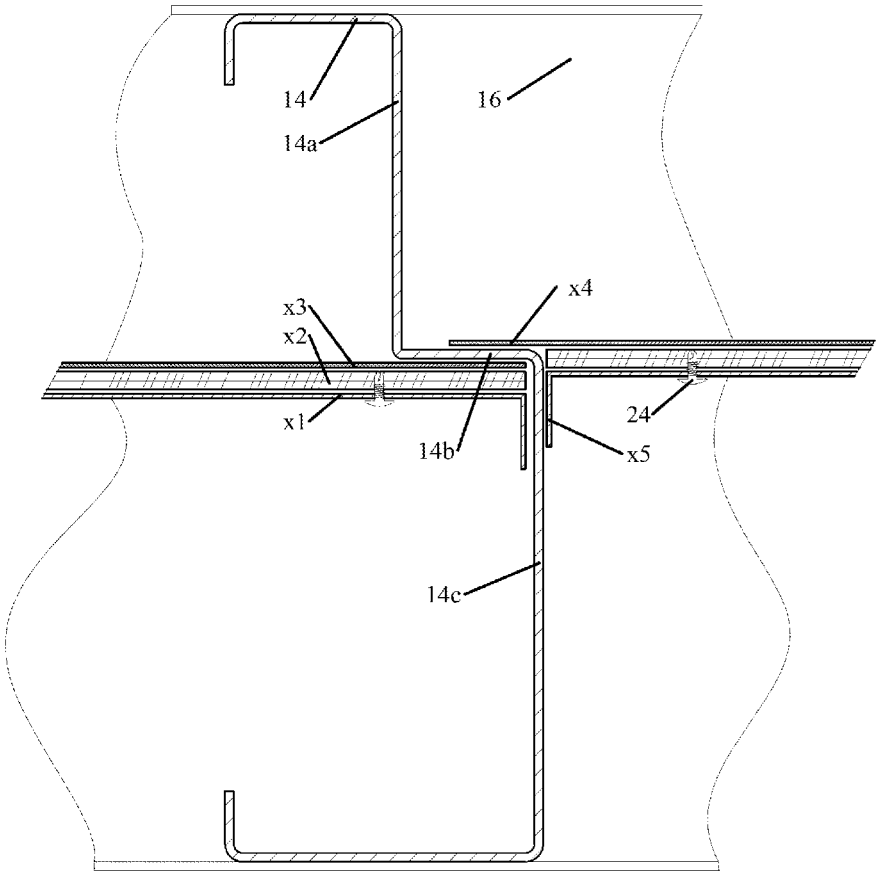
FIG. 14 is a plan detail of two panels meeting at a stud.

FIG. 14 is a plan detail of two panels as shown in FIGS. 10-13 meeting at a stud. This view is similar to that shown in FIG. 3 but with different panels.

Figure 15:
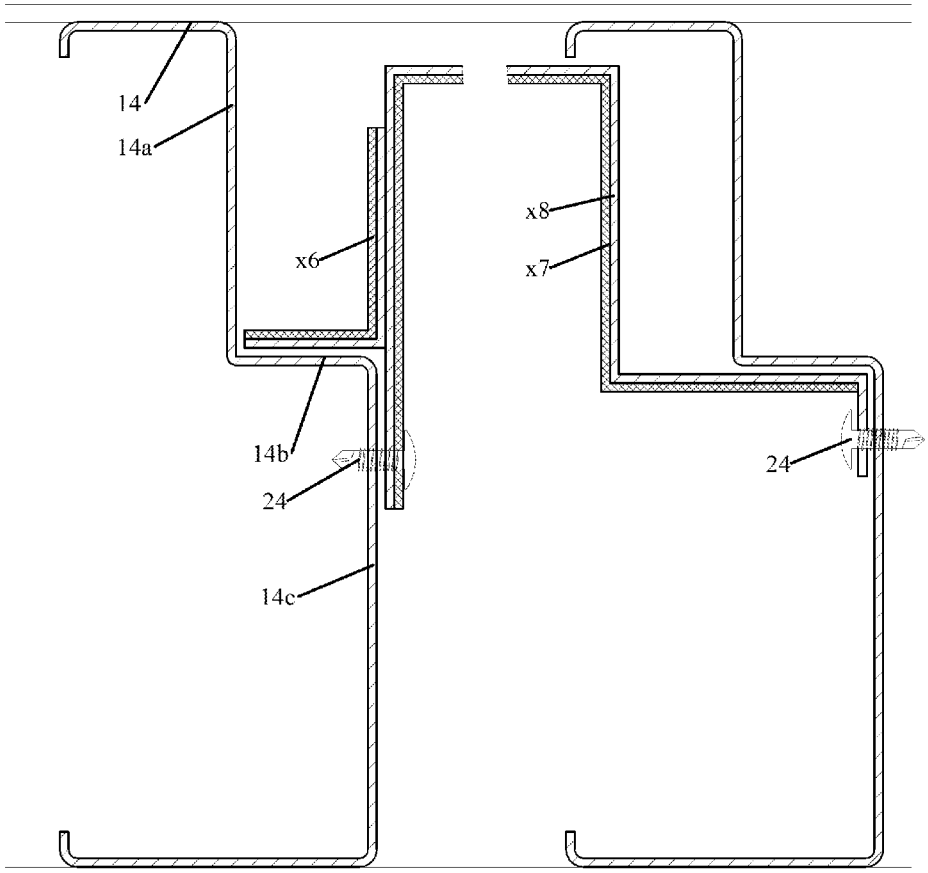
FIG. 15 is a plan detail of a deep enclosure box.
Figure 16:
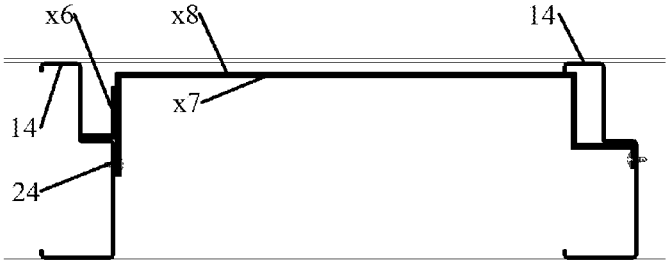
FIG. 16 is an overall plan of the deep enclosure box of FIG. 15.

FIG. 15 is a plan detail of a deep enclosure box x8. The deep enclosure box is a sheetmetal box designed so that you could recess a deep item (such as an electrical panel) inside the shielded wall, without affecting shielding integrity. It uses the same typical metal stud and is 2100 MM tall, or to suit the job site requirements. The standard width is sized to suit 16" o.c. studs however this can also be sized to suit the job site requirements. A piece of lead x7 is laminated to one side of the deep enclosure box to provide radiation protection. Another piece of lead x6 is attached to an end of the deep enclosure box to provide an overlap with another panel (not shown) that would extend across the other side of offset leg 14*b*. Piece of lead x6 may also be attached by lamination. FIG. 16 is an overall plan of the deep enclosure box of FIG. 15.

Figure 17:
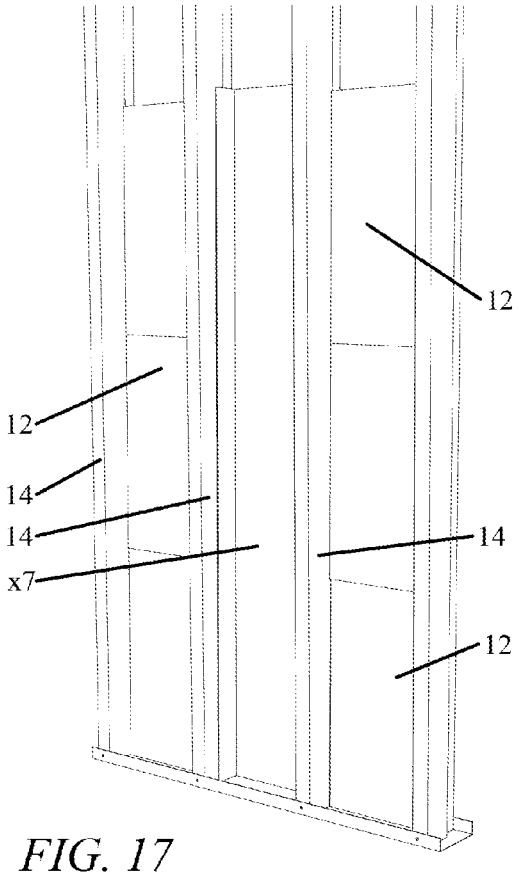
FIG. 17 is an elevation view of a wall portion.

FIG. 17 is an elevation view of a wall portion, showing four studs 14, six typical panels 12 in the two side stud cavities, and a deep enclosure box x7 visible in the middle.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A radiation shielding barrier wall assembly comprising:
- wall elements including studs and support elements attached to and extending between the studs;
- sheets of radiation shielding material suspended across spaces between studs by the support elements; and
- adjacent radiation shielding sheets overlapping on either side of a portion of a stud.

2. The radiation shielding barrier wall assembly of claim 1 in which at least a stud is elongated in a first direction, and has a cross section in the plane perpendicular to the first direction having bends and at least a leg between the bends, the cross section of the stud comprising a first leg at one end of the cross section and a second leg at another end of the cross section and further comprising an offset leg located between the first leg and the second leg, the offset leg being arranged to allow a sheet or radiation shielding material supported by a wall element to one side of the stud to extend adjacent to the offset leg to overlap with a sheet of radiation shielding material supported adjacent to the offset leg by a wall element to the other side of the stud.

3. The radiation shielding barrier wall assembly of claim 2 further comprising a restraining bar attached to the at least a stud to hold the sheet of radiation shielding material extending adjacent to the leg.

4. The radiation shielding barrier wall assembly of claim 1 in which the support elements include support bars attached to and extending between the studs, and the sheets of radiation shielding material are suspended from the support bars.

5. The radiation shielding barrier wall assembly of claim 1 in which the support elements include a substrate to which the radiation shielding material is attached.

6. The radiation shielding barrier wall assembly of claim 5 in which the substrate comprises plywood, fibreboard or drywall.

7. The radiation shielding barrier wall assembly of claim 5 in which the radiation shielding material is laminated to the substrate.

8. The radiation shielding barrier wall assembly of claim 5 in which the substrate is attached to brackets extending between and attached to the studs.

9. The radiation shielding barrier wall assembly of claim 1 further comprising finishing material attached to the studs and enclosing the sheets of radiation shielding material.

10. The radiation shielding barrier wall assembly of claim 1 in which the studs extend between a top track and a bottom track.

11. The radiation shielding barrier wall assembly of claim 1 further comprising a corner assembly for a bend in the wall, the corner assembly comprising radiation shielding material attached to sheet metal, the corner assembly being attached to a stud at one side of the corner assembly, and attached to another stud at an opposite side of the corner assembly, and the corner assembly having a bend between the side and the opposite side.

12. A radiation shielding barrier wall assembly comprising:
- studs;
  - support bars attached to and extending between the studs;
  - sheets of radiation shielding material suspended from the support bars; and
  - in which at least a stud is elongated in a first direction, and has a cross section in the plane perpendicular to the first direction having bends and at least a leg between the bends, the cross section of the stud comprising a first leg at one end of the cross section and a second leg at another end of the cross section and further comprising an offset leg located between the first leg and the second leg, the offset leg being arranged to allow a sheet of radiation shielding material suspended from a support bar to one side of the stud to extend adjacent to the leg to overlap with a sheet of radiation shielding material suspended from a support bar to the other side of the stud.

13. The radiation shielding barrier wall assembly of claim 12 further comprising a restraining bar attached to the at least a stud to hold the sheet of radiation shielding material extending adjacent to the leg.

14. The radiation shielding barrier wall assembly of claim 12 further comprising finishing material attached to the studs and enclosing the support bars and sheets of radiation shielding material.

15. The radiation shielding barrier wall assembly of claim 12 in which the studs extend between a top track and a bottom track.

16. The radiation shielding barrier wall assembly of claim 12 in which each of the sheets of radiation shielding material comprises a foldover edge which extends over the top of a support bar when the respective sheet of radiation shielding material is suspended from the respective support bar.

17. The radiation shielding barrier wall assembly of claim 12 further comprising a corner assembly for a bend in the wall, the corner assembly comprising radiation shielding material attached to sheet metal, the corner assembly being attached to a stud at one side of the corner assembly, and attached to another stud at an opposite side of the corner assembly, and the corner assembly having a bend between the side and the opposite side.

18. The radiation shielding barrier wall assembly of claim 1 in which the sheets of radiation shielding material comprise radiation shielding lead panels.

19. A radiation shielding barrier wall assembly comprising:

wall elements including studs;

sheets of radiation shielding material supported by the wall elements;

adjacent radiation shielding sheets overlapping on either side of a portion of a stud; and in which at least a stud is elongated in a first direction, and has a cross section in the plane perpendicular to the first direction having bends and at least a leg between the bends, the cross section of the stud comprising a first leg at one end of the cross section and a second leg at another end of the cross section and further comprising an offset leg located between the first leg and the second leg, the offset leg being arranged to allow a sheet or radiation shielding material supported by a wall element to one side of the stud to extend adjacent to the offset leg to overlap with a sheet of radiation shielding material supported adjacent to the offset leg by a wall element to the other side of the stud.

20. The radiation shielding barrier wall assembly of claim 19 further comprising a restraining bar attached to the at least a stud to hold the sheet of radiation shielding material extending adjacent to the leg.

21. The radiation shielding barrier wall assembly of claim 19 in which the wall elements include support bars attached to and extending between the studs, and the sheets of radiation shielding material are suspended from the support bars.

22. The radiation shielding barrier wall assembly of claim 19 in which the wall elements include a substrate to which the radiation shielding material is attached.

23. The radiation shielding barrier wall assembly of claim 22 in which the substrate comprises plywood, fibreboard or drywall.

24. The radiation shielding barrier wall assembly of claim 22 in which the radiation shielding material is laminated to the substrate.

25. The radiation shielding barrier wall assembly of claim 22 in which the substrate is attached to brackets extending between and attached to the studs.

26. The radiation shielding barrier wall assembly of claim 19 further comprising finishing material attached to the studs and enclosing the sheets of radiation shielding material.

27. The radiation shielding barrier wall assembly of claim 19 in which the studs extend between a top track and a bottom track.

28. The radiation shielding barrier wall assembly of claim 19 further comprising a corner assembly for a bend in the wall, the corner assembly comprising radiation shielding material attached to sheet metal, the corner assembly being attached to a stud at one side of the corner assembly, and attached to another stud at an opposite side of the corner assembly, and the corner assembly having a bend between the side and the opposite side.

* * * * *